US006119999A

United States Patent [19]

Fleishman

[11] Patent Number: 6,119,999

[45] Date of Patent: Sep. 19, 2000

[54] PICTURE HANGING SYSTEM

[76] Inventor: David Fleishman, 565 Avenue Road, Suite 204, Toronto, Ontario, Canada, M4V 2J9

[21] Appl. No.: 09/105,139

[22] Filed: Jun. 26, 1998

[51] Int. Cl.[7] ..... A47G 1/16

[52] U.S. Cl. ..... 248/489; 248/340; 248/495

[58] Field of Search ..... 248/489, 490, 248/495, 497, 498, 492, 493, 494, 475.1, 476, 470, 317, 323, 328, 340, 322, 320; 211/113, 116, 117, 119; 40/617, 613, 700, 757

[56] References Cited

U.S. PATENT DOCUMENTS

| | | | |
|---|---|---|---|
| 145,709 | 12/1873 | Worrell et al. | 248/340 |
| 271,715 | 2/1883 | Kluge | 248/493 |
| 383,873 | 6/1888 | Fay | 248/495 |
| 437,470 | 9/1890 | Wright | 248/493 |
| 740,493 | 10/1903 | Wade | 248/498 |
| 969,195 | 9/1910 | Rothstein | 248/493 |
| 1,442,036 | 1/1923 | Baker | 248/495 |
| 2,242,804 | 5/1941 | Trowbridge | 40/756 |
| 2,723,096 | 11/1955 | Schwartz | 248/498 |
| 3,030,718 | 4/1962 | Kirkman | 40/617 |
| 3,188,028 | 6/1965 | Waller | 248/489 |
| 4,091,976 | 5/1978 | Morse | 224/45 R |
| 5,020,720 | 6/1991 | Harpe | 232/39 |
| 5,480,116 | 1/1996 | Callas | 248/228.4 |

*Primary Examiner*—Ramon O. Ramirez
*Assistant Examiner*—Anita M. King
*Attorney, Agent, or Firm*—Dimock Stratton Clarizio; Mark B. Eisen

[57] ABSTRACT

A picture hanging system comprising a rod from which one or more pictures are suspended by a pair of wires or cables. In the preferred embodiment the cables are each suspended from a link comprising turnbuckle or the like having a nut affixed to a bolt, so that the picture may be levelled merely by rotating the nut relative to the bolt (or vice versa) to reduce or increase the spacing between the rod and each side of the picture.

17 Claims, 3 Drawing Sheets

PICTURE HANGING SYSTEM

FIELD OF THE INVENTION

This invention relates to picture frames. In particular, this invention relates to a picture hanging system for hanging and levelling pictures.

BACKGROUND OF THE INVENTION

Pictures, including paintings, posters, photographs and the like, are frequently framed for hanging on a wall or other vertical surface. Conventional systems for hanging pictures include a cable or wire affixed to the rear of a frame, either along the sides or the top of the frame, for suspending the frame on a hook affixed to the wall. Other methods may include clips or brackets affixed to the rear of the frame for suspending the frame on a hook, nail or other fastener affixed to the wall.

In such systems it can be difficult to level the picture when hung. It can also be difficult to re-level the picture, which is required from time to time as the picture shifts due to dusting, knocking or normal settling of the structure in which it is hung. Moreover, it can be difficult to hang the picture because the wire, clip or other hanging means is concealed behind the picture and is thus difficult to align with the hook or fastener when hanging the picture. Providing a visible wire or clip is generally undesirable as it detracts from the aesthetic appeal of the picture.

Also, in conventional picture hanging systems each picture must be hung independently, making the alignment of adjacent pictures difficult and generally unchangeable once the pictures are hung.

It would accordingly be advantageous to provide a picture hanging system by which the picture is easy to hang and to level, and which is aesthetically pleasing. It would further be an advantage to provide a picture hanging system capable of hanging a plurality of pictures, to thereby facilitate the arrangement and alignment of pictures and allow this to be readily changed when desired.

SUMMARY OF THE INVENTION

The present invention overcomes these disadvantages by providing a modular picture hanging system comprising a rod from which one or more pictures are suspended by a pair of wires or cables. In the preferred embodiment the cables are each suspended from a link comprising turnbuckle or the like having a nut affixed to a bolt, so that the picture may be levelled merely by rotating the nut relative to the bolt (or vice versa) to reduce or increase the spacing between the rod and each side of the picture.

The picture hanging system of the invention is aesthetically appealing and at the same time readily accessible and easy to adjust. Moreover, the picture hanging system of the invention is capable of hanging multiple pictures, with or without frames and each independently adjustable and positionable but suspended from the same structure. Thus the sizes, heights and arrangement of a group of pictures can be changed while using the same supporting hardware, which obviates the need to make additional holes in a wall to accommodate these changes. The picture hanging system of the invention is also suitable for hanging one or more pictures within a viewing area spaced from a wall, so that the pictures are visible from both sides, which allows more pictures to be hung in a single space and increases the available positions and arrangements for hanging pictures.

The present invention thus provides a picture hanging system comprising at least two suspending members each affixed to an adjustable link comprising a nut threadedly engaged to a threaded fastener, whereby rotation of the nut in one direction increases a length of the link and rotation of the nut in an opposite direction decreases a length of the link, wherein a picture suspended from the suspending members can be levelled by adjustment of the adjustable links.

The present invention further provides a picture hanging system comprising a rod, and at least two suspending members, each affixed to an adjustable link comprising a nut threadedly engaged to a threaded fastener whereby rotation of the nut in one direction increases a length of the link and rotation of the nut in an opposite direction decreases a length of the link, the links being suspended from the rod, wherein a picture suspended from the suspending members can be levelled by adjustment of the adjustable links.

The present invention further provides a kit of parts for a picture hanging system, comprising at least one rod, at least two suspending members, and at least two adjustable links each comprising a nut threadedly engaged to a threaded fastener whereby rotation of the nut in one direction increases a length of the link and rotation of the nut in an opposite direction decreases a length of the link, the links being adapted to be suspended from the rod, wherein a picture suspended from the suspending members can be levelled by adjustment of the adjustable links.

BRIEF DESCRIPTION OF THE DRAWINGS

In drawings which illustrate by way of example only a preferred embodiment of the invention.

DETAILED DESCRIPTION OF THE INVENTION

Figure 1:
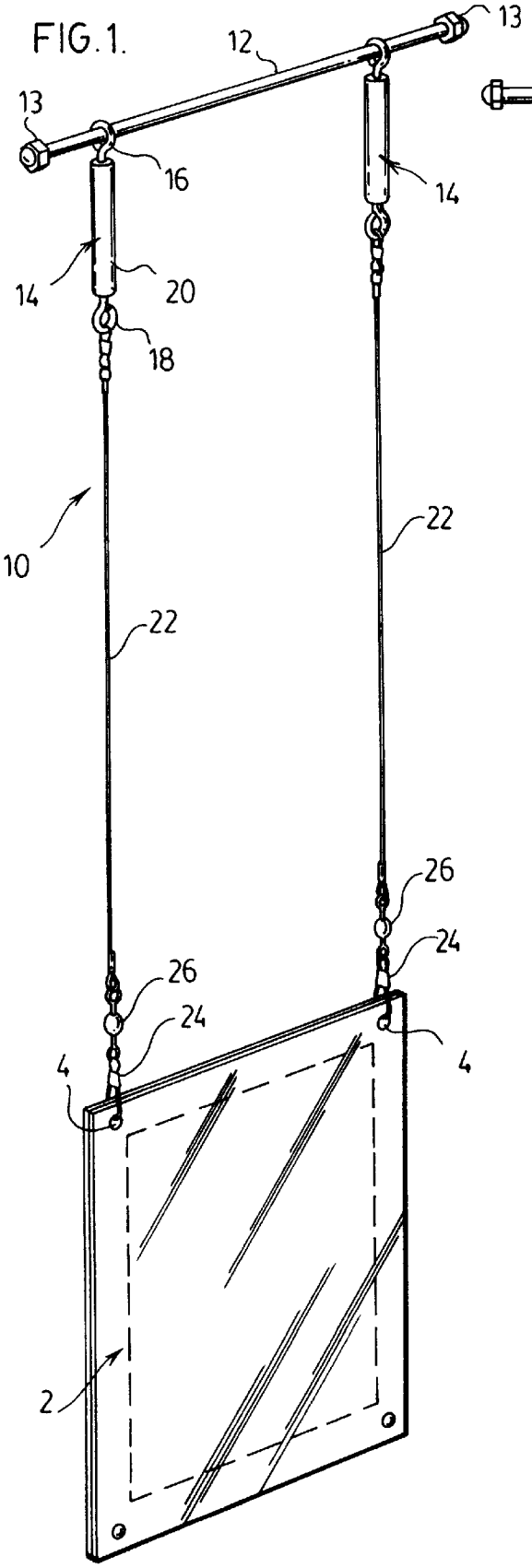
FIG. 1 is a perspective view of the picture hanging system.

FIGS. 1 to 7 illustrate a preferred embodiment of the picture hanging system 10 of the invention. The picture hanging system 10 includes a rod 12, which may be mounted on hooks, fasteners or other suitable hardware (not shown) affixed to a wall or other vertical surface, or suspended by wires or cables (not shown) from a ceiling. Suspended from the rod, either directly or by wires, cables or other suspending means, are adjustable links 14.

In the preferred embodiment the links 14 comprise conventional turnbuckles, with either a threaded bolt on one side and a swivel on the other or, as in the embodiment shown, threaded bolts 16, 18 on both sides with oppositely directed threads such that by rotating the nut 20 in one direction the bolts 16, 18 extend further out of the nut 20 and by rotating the nut 20 in the opposite direction the bolts 16, 18 retract into the nut 20. However the links 14 can be any adjustable type of link, such as an ordinary threaded nut on a bolt, so long as upon rotation of the nut the length of the link increases or decreases. In the preferred embodiment the bolts 16, 18 have hooked or looped outer ends to facilitate suspending the bolts 16, 18 on the rod 12 and affixing suspending members thereto.

In the preferred embodiment the suspending members comprise cables 22 which are affixed to the bolts 18 by any conventional means, in the embodiment shown by crimping a loop at the end of each cable 22 and disposing the hooked or looped end of the bolt 18 through the loop in the cable. The suspending members may also be ropes, threads, rods, bars or any other elongate member having a fixed length.

The suspending cables 22 are in turn affixed to the picture 2 in any suitable fashion. In the embodiment shown the suspending cables 22 are provided at their lower ends with hooks or clips 24 disposed through holes 4 in the picture frame, or in the picture 2 itself, however any other suitable means of suspending the picture 2 from the cables 22 may be employed and the invention is not intended to be limited thereby.

In the preferred embodiment swivels 26 are interposed between the cables 22 and the picture 2, so that the cables 22 will not twist or deform if the cables 22 turn as the nuts 20 are turned.

In use, the links 12 are affixed to the upper ends of the cables 22, and the lower ends of the cables 22 are affixed to the picture 2 in any desired fashion. Optionally nuts 13, clips or other suitable capping members may be affixed to the ends of the rod 12, or to intermediate positions on the rod 12, to prevent the links 14 from sliding off of the rod 12.

The rod 12 is mounted on hooks, fasteners or other suitable hardware, or on cables suspended from a wall or ceiling (not shown). The picture 2 may then be levelled by adjusting links 14, by rotating the nuts 20 until the desired level of each side of the picture 2 has been achieved. Minor adjustments in the height of the picture 2 may also be made by adjusting the links in equal amounts, and more significant adjustments in height may be made by lengthening or shortening the suspending cables 22.

It can be seen that the picture hanging system 10 of the invention will adjust to a picture 2 of any width merely by sliding the links 14 along the rod 12. Also, although the cables 22 are shown as hanging vertically, by placing clips or the like (not shown) at desired positions along the rod 12 the links 14 may be laterally fastened so that the cables 22 hang at an oblique angle.

Figure 7:
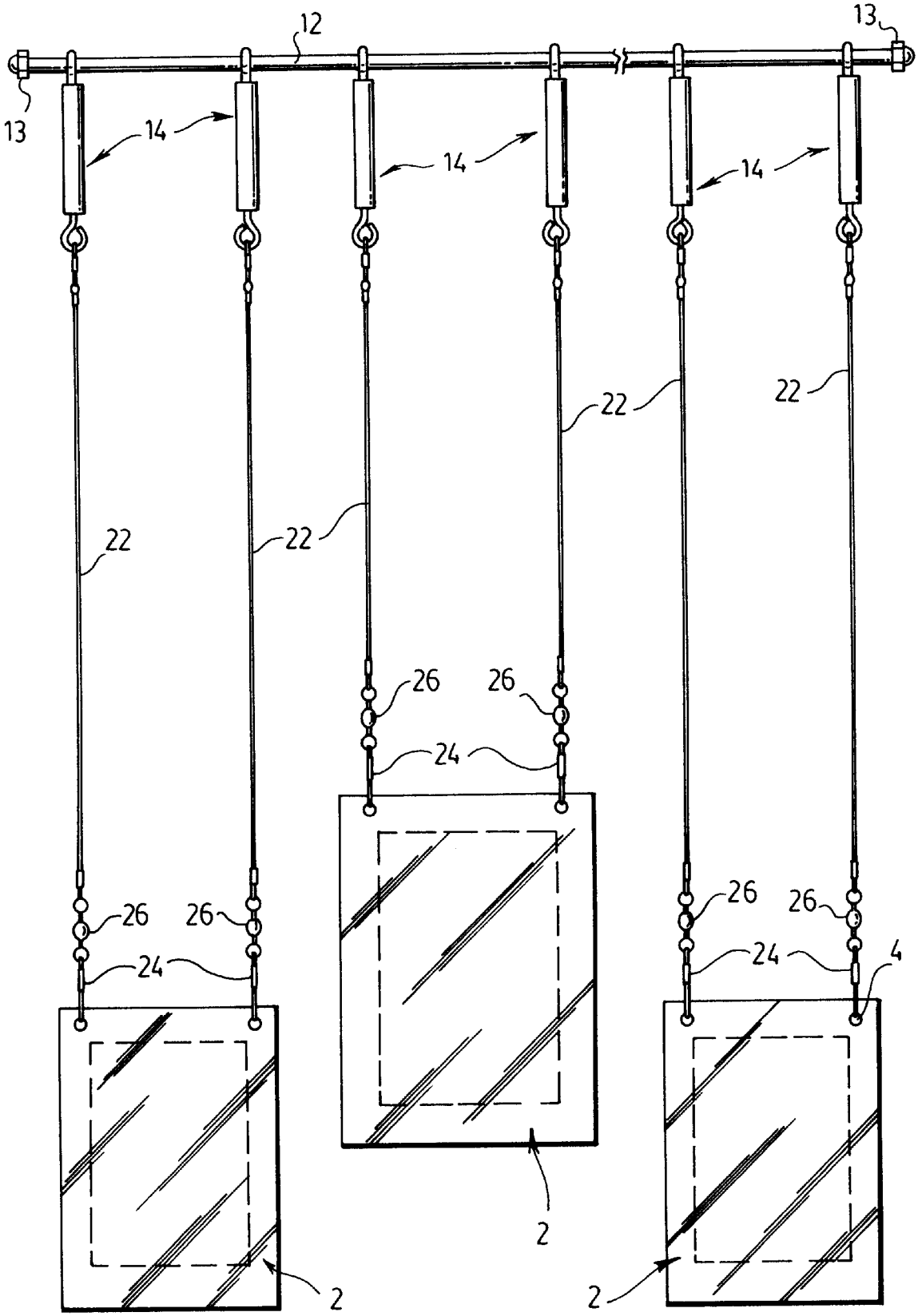
FIG. 7 is a front elevation of a group of pictures hung according to the picture hanging system of FIG. 1.

FIG. 7 illustrates an embodiment of the invention having a plurality of pictures 2 suspended from a single rod 12. Each picture 2 can be moved laterally into the desired position merely by sliding the links 20 along the rod 12, and this positioning can be readily changed as desired.

It is also possible to omit the rod 12 and suspend the cables 22 directly from hooks or other fasteners (not shown) affixed to a wall or ceiling, however this is a somewhat less versatile embodiment of the invention because the cables 22 are then laterally fixed to the wall so lateral repositioning of the picture 2 becomes more difficult.

Figure 2:
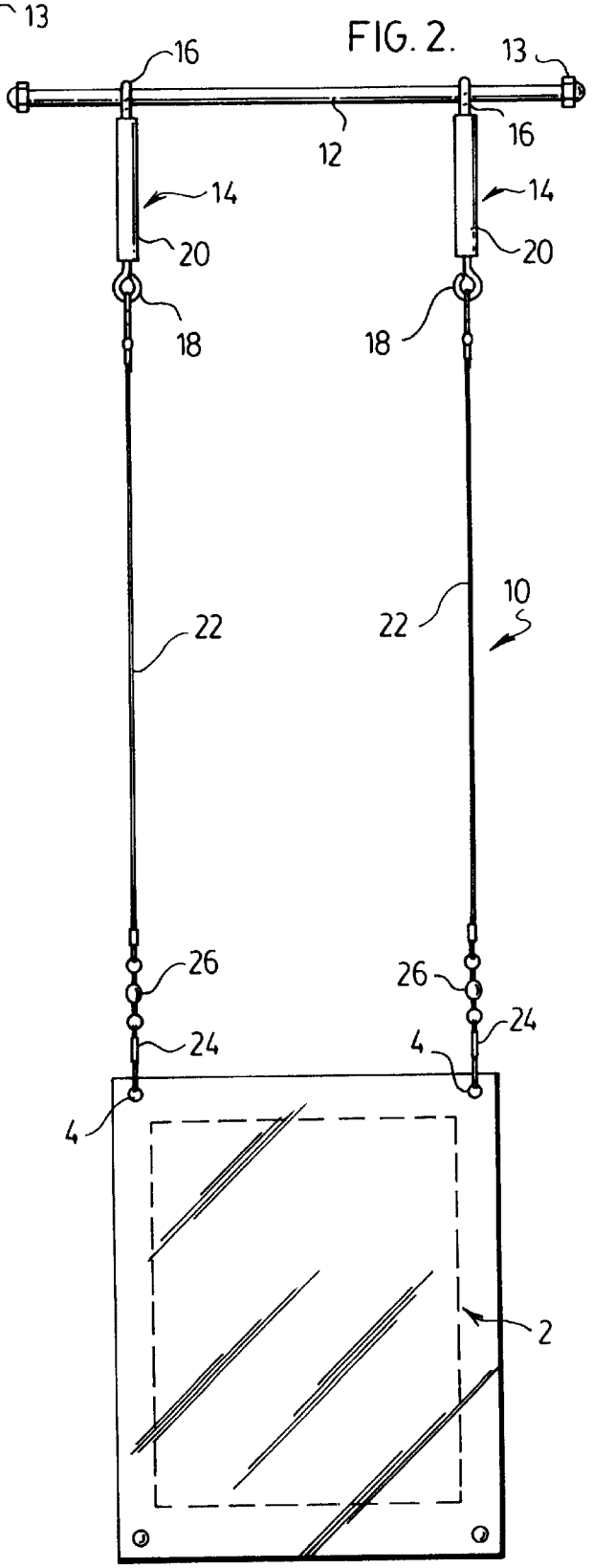
FIG. 2 is a front elevation of the picture hanging system of FIG. 1.
Figure 3:
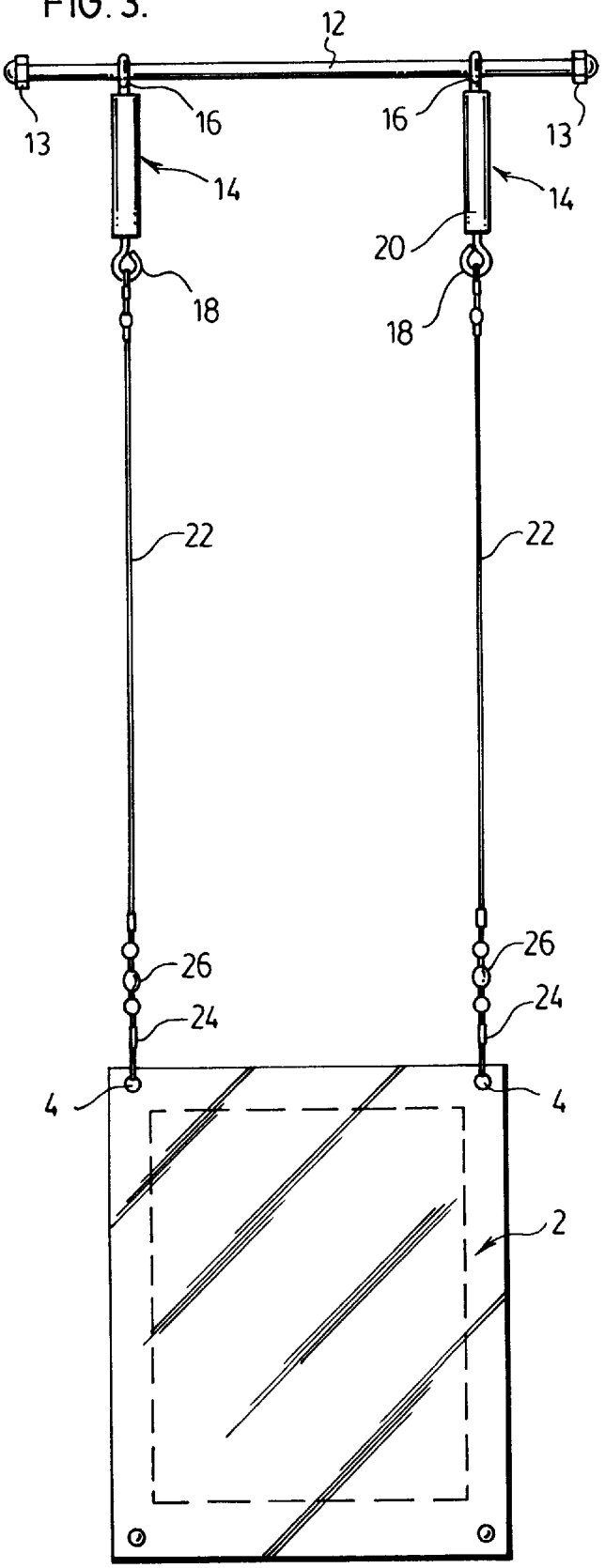
FIG. 3 is a rear elevation of the picture hanging system of FIG. 1.
Figure 4:
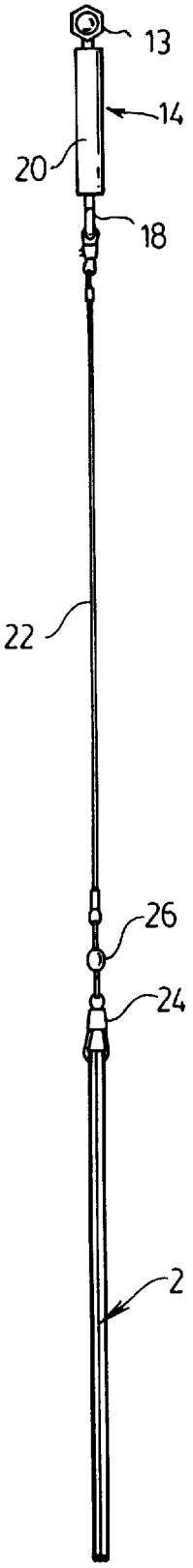
FIG. 4 is side elevation of the picture hanging system of FIG. 1.
Figure 5:
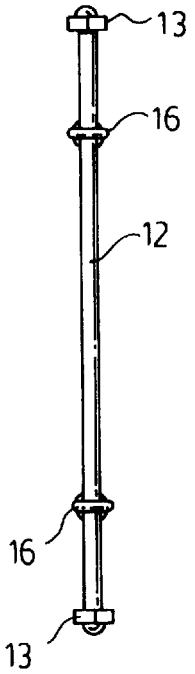
FIG. 5 is a top plan view of the picture hanging system of FIG. 1.
Figure 6:
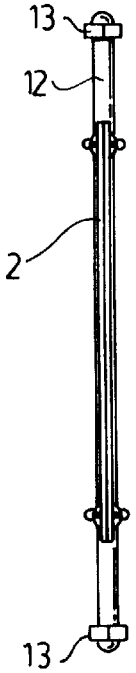
FIG. 6 is a bottom plan view of the picture hanging system of FIG. 1.

It will be appreciated that because the picture hanging system 10 is essentially identical in appearance from the front or the back, the picture hanging system 10 may be suspended within a viewing area spaced from a wall, so that the pictures 2 can be viewed from both faces, as shown in FIGS. 2 and 3. Thus, two paintings, posters, photographs or the like may be mounted back-to-back in the picture 2 and both would be viewable depending upon the position of the viewer.

The embodiment illustrated utilizes a frameless picture, in which the painting, poster, photograph or the like is disposed between two panes of glass. The system of the invention is advantageously employed in such cases because a pair of holes 4 in the glass is sufficient to suspend the picture 2. However, the invention is not intended to be so restricted and can be utilized with other framed and frameless picture systems in the manner described above. Also, additional hardware (not shown) can be affixed to the bottom of a picture 2 from which another picture 2 can be suspended at a lower height.

A preferred embodiment of the invention having been thus described by way of example only, it will be apparent to those skilled in the art that certain modifications and adaptations may be made without departing from the scope of the invention, as set out in the appended claims.

I claim:

1. A picture hanging system comprising at least two suspending members each affixed to an adjustable link comprising a nut threadedly engaged to a threaded fastener, whereby rotation of the nut in one direction increases a length of the link and rotation of the nut in an opposite direction decreases a length of the link, whereby a picture suspended from the suspending members can be levelled by adjustment of the adjustable links, wherein the links comprise turnbuckles and the suspending members are suspended from lower portions of the turnbuckles.

2. The picture hanging system of claim 1 in which the turnbuckles comprise oppositely threaded bolts extending out of the nut.

3. The picture hanging system of claim 1 in which the links are suspended from a rod.

4. The picture hanging system of claim 3 in which the links are slidably suspended from the rod.

5. The picture hanging system of claim 4 in which the rod is provided with end capping members to prevent the links from sliding off of the rod.

6. The picture hanging system of claim 1 in which a swivel is interposed between the suspending members and the picture.

7. The picture hanging system of claim 1 including a plurality of pairs of suspending members for hanging a plurality of pictures.

8. The picture hanging system of claim 1 in which the suspending members are affixed to pictures by hooks.

9. A picture hanging system comprising a rod, and at least two suspending members, each affixed to an adjustable link comprising a nut threadedly engaged to a threaded fastener whereby rotation of the nut in one direction increases a length of the link and rotation of the nut in an opposite direction decreases a length of the link, the links being suspended from the rod, wherein the links comprise turnbuckles and the suspending members are suspended from lower portions of the turnbuckles such that a picture suspended from the suspending members can be levelled by adjustment of the turnbuckles.

10. The picture hanging system of claim 9 in which the turnbuckles comprise oppositely threaded bolts extending out of the nut.

11. The picture hanging system of claim 9 in which the rod is provided with end capping members to prevent the links from sliding off of the rod.

12. The picture hanging system of claim 9 in which a swivel is interposed between the suspending members and the picture.

13. The picture hanging system of claim 9 including a plurality of pairs of suspending members for hanging a plurality of pictures.

14. The picture hanging system of claim 9 in which the suspending members are affixed to the pictures by hooks.

15. A kit of parts for a picture hanging system, comprising at least one rod, at least two suspending members, and at least two adjustable links each comprising a nut threadedly engaged to a threaded fastener whereby rotation of the nut in one direction increases a length of the link and rotation of the nut in an opposite direction decreases a length of the link, the links being adapted to be suspended from the rod, wherein a picture suspended from the suspending members can be levelled by adjustment of the adjustable links, and wherein the links comprise turnbuckles and the suspending members are suspended from lower portions of the turnbuckles.

16. The kit of parts of claim 15 in which the rod is provided with end capping members to prevent the links from sliding off of the rod.

17. The picture hanging system of claim 15 including at least two swivels for interposition between the suspending members and a picture.

* * * * *